US008610643B2

(12) United States Patent
Oh et al.

(10) Patent No.: US 8,610,643 B2
(45) Date of Patent: Dec. 17, 2013

(54) DISPLAY DEVICE AND METHOD OF DRIVING THE SAME

(75) Inventors: Se-Chun Oh, Seongnam-si (KR); Ryu-Hwa Sung, Seoul (KR)

(73) Assignee: Samsung Display Co., Ltd. (KR)

( * ) Notice: Subject to any disclaimer, the term of this patent is extended or adjusted under 35 U.S.C. 154(b) by 895 days.

(21) Appl. No.: 11/842,459

(22) Filed: Aug. 21, 2007

(65) Prior Publication Data

US 2008/0094333 A1 Apr. 24, 2008

(30) Foreign Application Priority Data

Oct. 20, 2006 (KR) ..... 10-2006-0102603

(51) Int. Cl.

| | |
|---|---|
| ***G09G 3/10*** | (2006.01) |
| ***G09G 3/00*** | (2006.01) |
| ***G09G 3/36*** | (2006.01) |
| ***G11C 8/00*** | (2006.01) |
| ***G06F 1/26*** | (2006.01) |
| ***G06F 1/32*** | (2006.01) |
| ***H04N 3/14*** | (2006.01) |

(52) U.S. Cl.

USPC ..... 345/42; 345/30; 345/98; 365/230.05; 713/320; 348/790

(58) Field of Classification Search

USPC ..... 345/30–100

See application file for complete search history.

(56) References Cited

U.S. PATENT DOCUMENTS

| | | | | |
|---|---|---|---|---|
| 7,193,637 | B2 | 3/2007 | Kudo et al. | |
| 7,418,606 | B2 * | 8/2008 | Holmer | 713/320 |
| 7,613,065 | B2 * | 11/2009 | Chung | 365/230.05 |
| 2001/0043166 | A1 * | 11/2001 | Jacobsen et al. | 345/27 |
| 2002/0036635 | A1 | 3/2002 | Shimamoto | |
| 2005/0017965 | A1 | 1/2005 | Morita et al. | |
| 2005/0146494 | A1 * | 7/2005 | Aoki et al. | 345/95 |
| 2006/0044249 | A1 * | 3/2006 | Lee et al. | 345/98 |
| 2006/0125760 | A1 | 6/2006 | Jee et al. | |
| 2006/0187362 | A1 * | 8/2006 | Uehara | 348/790 |
| 2007/0063991 | A1 * | 3/2007 | Lee et al. | 345/173 |

FOREIGN PATENT DOCUMENTS

| | | | |
|---|---|---|---|
| CN | 1632848 | A | 6/2005 |
| CN | 1637830 | A | 7/2005 |
| CN | 1744189 | A | 3/2006 |
| CN | 1783198 | A | 6/2006 |
| JP | 08030574 | | 2/1996 |
| JP | 08314417 | | 11/1996 |
| JP | 2000105566 | | 4/2000 |
| JP | 2002082655 | | 3/2002 |
| JP | 2004029540 | | 1/2004 |
| JP | 2005043435 | | 2/2005 |
| KR | 1020010070215 | A | 7/2001 |
| KR | 1020010070251 | A | 7/2001 |
| KR | 1020050019284 | | 3/2005 |
| KR | 1020050112861 | | 12/2005 |
| KR | 1020060020074 | A | 3/2006 |
| KR | 100570775 | | 4/2006 |
| KR | 1020060032259 | | 4/2006 |
| KR | 1020060065943 | | 6/2006 |

* cited by examiner

*Primary Examiner* — Charles V Hicks
(74) *Attorney, Agent, or Firm* — Cantor Colburn LLP

(57) ABSTRACT

A display device and a method of the driving the same include a display panel assembly, a driving unit which drives the display panel assembly, and a serial peripheral interface which includes a plurality of registers, the plurality of registers being divided into groups of at least two blocks, and which receives external driving signals through serial communications and thereby controls the driving unit.

14 Claims, 6 Drawing Sheets

DISPLAY DEVICE AND METHOD OF DRIVING THE SAME

This application claims priority to Korean Patent Application No. 10-2006-0102603, filed on Oct. 20, 2006, and all the benefits accruing therefrom under 35 U.S.C. §119, the contents of which in its entirety are herein incorporated by reference.

BACKGROUND OF THE INVENTION (a) Field of the Invention

The present invention relates to a display device and a method of driving the same. More particularly, the present invention relates to a display device having improved serial communication speed, and a driving method thereof.

(b) Description of the Related Art

A liquid crystal display ("LCD") is a type of flat panel display that has come into widespread use in recent years. The LCD includes two display panels on which electric field generating electrodes, such as pixel electrodes and a common electrode, are formed, and a liquid crystal layer interposed therebetween. In the LCD, a voltage is applied to the electric field generating electrodes, generating an electric field in the liquid crystal layer. The electric field determines the alignment of liquid crystal molecules in the liquid crystal layer, and the polarization of incident light is thereby controlled, displaying a desired image.

The LCD further includes switching elements connected to the respective pixel electrodes, and a plurality of gate lines and data lines which control the switching elements in order to apply a voltage to the pixel electrodes.

Among the various LCD devices, small and medium display devices are generally used for cellular phones or other similar devices, and typically include a liquid crystal panel assembly, a flexible printed circuit ("FPC") board with signal wiring lines which receive an external driving signal, and a single integrated circuit ("IC") chip which controls the above-described components.

Further, the single IC chip typically includes a serial peripheral interface ("SPI") which allows data exchange of external driving signals with a driving unit of the LCD via serial communications.

BRIEF SUMMARY OF THE INVENTION

Exemplary embodiments of the present invention have been made in an effort to provide a display device, and a method of driving the same, having an advantage of increased SPI operating speed, which allows improved data exchange of external driving signals through serial communications with a driving unit of the display device.

One exemplary embodiment of the present invention provides a display device which includes a display panel assembly, a driving unit which drives the display panel assembly, and an SPI which receives an external driving signal, controls the driving unit, and includes a plurality of registers. The plurality of registers are divided into groups of at least two blocks. The driving signal includes a serial data input signal, and the serial data input signal includes a block selecting bit and a plurality of data bits. The block selecting bit selects one of the at least two blocks and applies the appropriate data bits to a register associated with the one selected block. Further, when the block selecting bit is 1 the data bits are recognized as block address bits; when the block selecting bit is 0 the data bits are recognized as command bits which control the driving unit.

The display panel assembly includes a plurality of pixels, each of which includes a switching element. The driving unit includes a driving voltage generator which generates driving voltages which drive the display panel assembly, a gate driver which generates gate signals on the basis of one of the driving voltages and applies the gate signals to the respective switching elements, a gray voltage generator which generates a plurality of gray voltages on the basis of one of the driving voltages, a data driver which generates data voltages on the basis of the gray voltages and applies the generated data voltages to the switching elements, and a signal controller which controls at least one of the driving voltage generator, the gate driver, the gray voltage generator, and/or the data driver.

The blocks include at least a first block, a second block and a third block.

Command bits which are inputted to the first block may include data which controls the signal controller, command bits which are inputted to the second block may include data which controls the generation of the driving voltages, and command bits which are inputted to the third block may include data which controls the generation of the gray voltages.

The driving voltages include a gate-on voltage and a gate-off voltage which are applied to the gate driver, a reference voltage which is applied to the gray voltage generator, and a common voltage which is applied to the pixels.

The driving unit and the SPI may be implemented in the form of one IC chip.

The IC chip may be directly mounted on the display panel assembly. The driving signal may further include an interface enable signal and a serial clock signal, and the SPI may recognize the serial clock signal when a voltage level of the interface enable signal changes from a high level to a low level.

The number of data bits may be 16.

The display device may further include a circuit board which is attached to the display panel assembly and is electrically connected to the driving unit and to the SPI.

The circuit board may be flexible.

Another exemplary embodiment of the present invention provides a method of driving a display device which includes a display panel assembly, a driving unit which drives the display panel assembly, and an SPI which includes a plurality of registers divided into groups of at least two blocks. The method includes inputting a block selecting bit to the SPI and inputting data bits to the block selected according to the value of the block selecting bit.

When the block selecting bit is 0 the data bits are recognized as block address bits which indicate an address of a particular block, and when the block selecting bit is 1 the data bits are recognized as command bits which control the driving unit.

The display panel assembly includes a plurality of pixels, each of which includes a switching element. The driving unit includes a driving voltage generator which generates driving voltages which drive the display panel assembly, a gate driver which generates gate signals on the basis of one of the driving voltages and applies the gate signals to the respective switching elements, a gray voltage generator which generates a plurality of gray voltages on the basis of one of the driving voltages, a data driver which generates data voltages on the basis of the gray voltages and applies the generated data voltages to the switching elements, and a signal controller which controls at least one of the driving voltage generator, the gate driver, the gray voltage generator, and/or the data driver.

The blocks include first, second and third blocks.

Command bits which inputted to the first block may include data which controls the signal controller, command bits which are inputted to the second block may include data which controls the generation of the driving voltages, and command bits which are inputted to the third block may include data which controls the generation of the gray voltages.

BRIEF DESCRIPTION OF THE DRAWINGS

The present invention will become more apparent by describing exemplary embodiments thereof in more detail with reference to the accompanying drawings, in which.

DETAILED DESCRIPTION OF THE INVENTION

Figure 1:
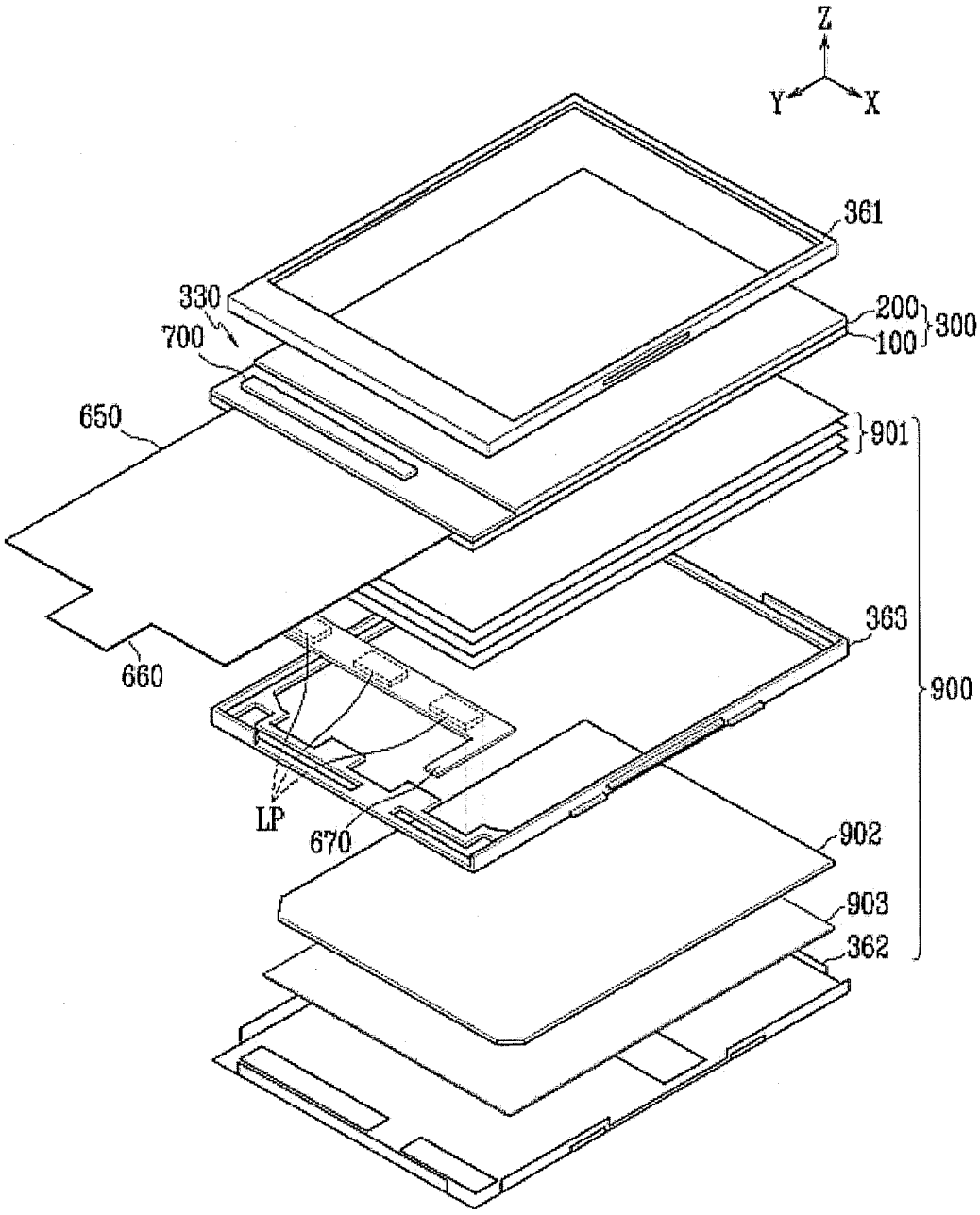
FIG. 1 is an exploded perspective view of a display device according to one exemplary embodiment of the present invention.

The invention now will be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third," etc. may be used herein to describe various elements, components, regions, layers, and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, a display device according to an exemplary embodiment of the present invention will be described in further detail with reference to the accompanying drawings.

Referring to FIG. 1, a display device according to one exemplary embodiment of the present invention includes a liquid crystal module which includes a display panel 330, a lighting unit 900, top and bottom chassis 361 and 362 which accommodate the liquid crystal module, and a molded frame 363.

The display panel 330 includes a liquid crystal panel assembly 300, and a driver chip 700 and a FPCB 650 which are attached to the liquid crystal panel assembly 300.

Figure 2:
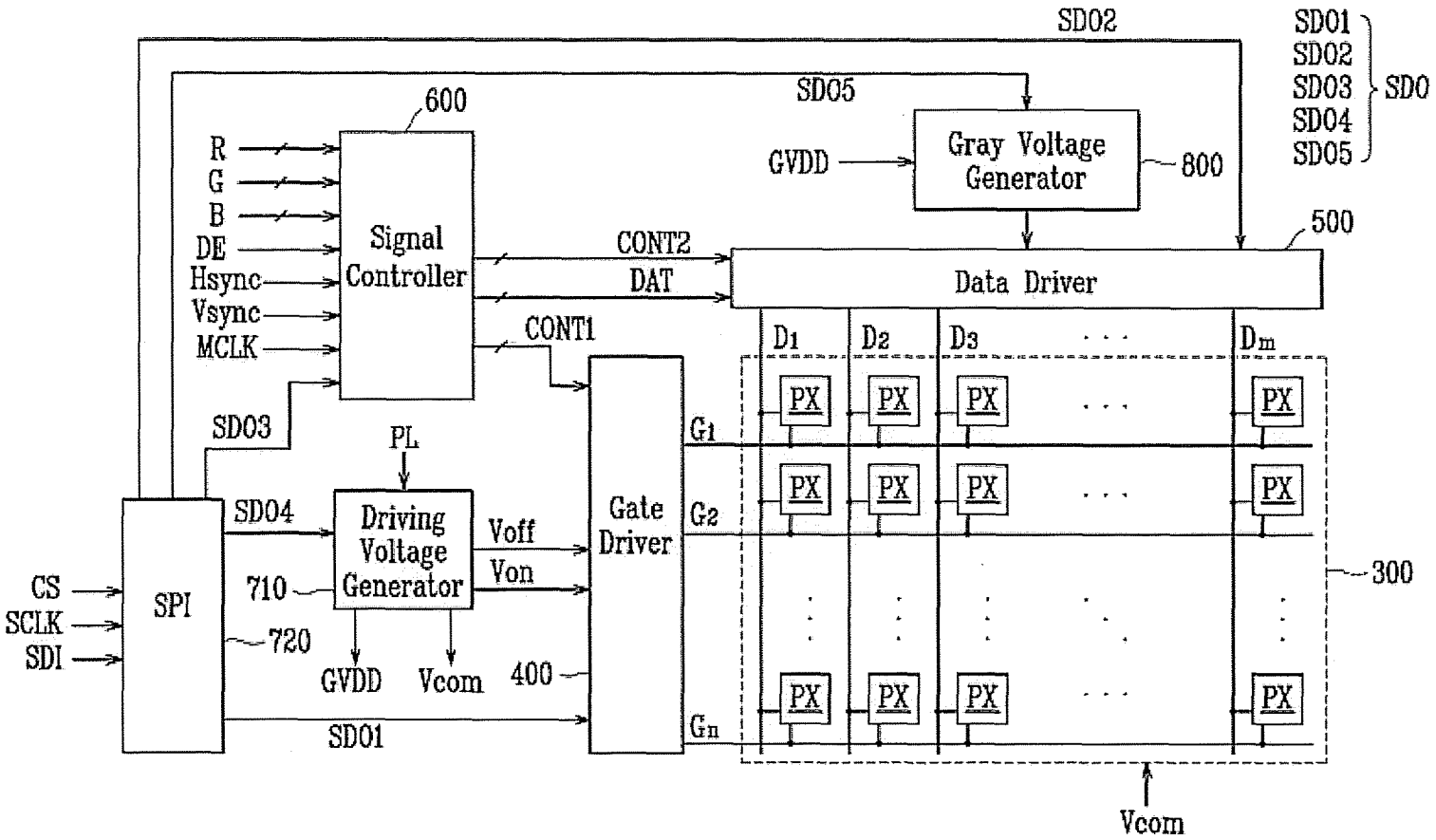
FIG. 2 is a block diagram of the display device according to one exemplary embodiment of the present invention.

Referring to FIG. 2, in a block diagram of a display device according to one exemplary embodiment of the present invention, the liquid crystal panel assembly 300 (not fully shown in FIG. 2) includes a plurality of signal lines $G_1$ to $G_n$ and $D_1$ to $D_m$, and a plurality of pixels PX. In an equivalent circuit diagram of one pixel PX shown in FIG. 3, the liquid crystal panel assembly 300 includes lower and upper panels 100 and 200 which face each other, and a liquid crystal layer 3 interposed therebetween.

Figure 3:
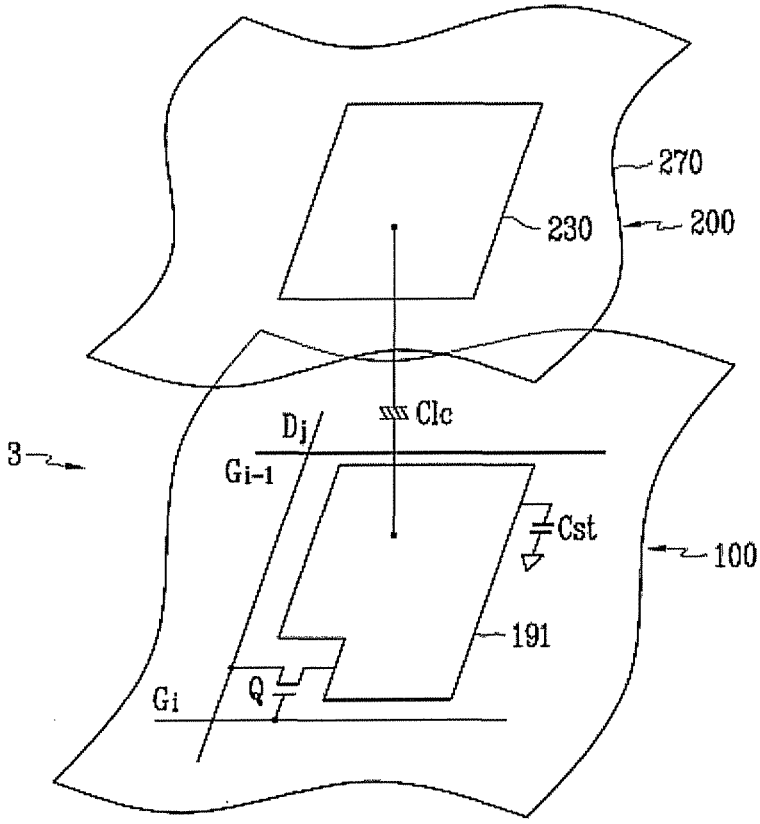
FIG. 3 is an equivalent circuit diagram of one pixel of the display device according to one exemplary embodiment of the present invention.

Further referring to FIGS. 2 and 3, the signal lines $G_1$ to $G_n$ and $D_1$ to $D_m$ are provided in the lower panel 100, and include a plurality of gate lines $G_1$ to $G_n$ which transmit gate signals (also referred to as "scanning signals") and a plurality of data lines $D_1$ to $D_m$ which transmit data voltages. The gate lines $G_1$ to $G_n$ extend substantially in a row direction so as to be substantially parallel to each other, and the data lines $D_1$ to $D_m$ extend substantially in a column direction so as to be substantially parallel to each other.

The pixels PX are arranged in a matrix. Each pixel PX includes a switching element Q connected to signal lines $G_i$ and $D_j$ (e.g., for a pixel PX connected to both an i-th (i=1, 2, . . . , n) gate line $G_i$ and a j-th (j=1, 2, . . . , m) data line $D_j$,) and a liquid crystal capacitor Clc and a storage capacitor Cst connected to the switching element Q. If necessary, the storage capacitor Cst may be eliminated.

Figure 4:
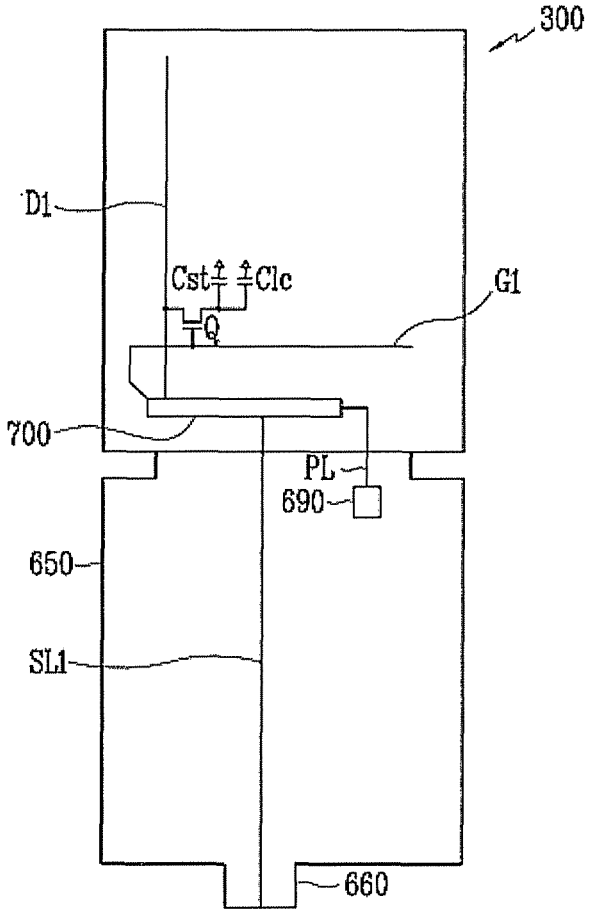
FIG. 4 is a partial schematic plan view layout of the display device according to one exemplary embodiment as shown in FIG. 1.

Referring to FIGS. 3 and 4, the switching element Q is a three-terminal element such as a thin film transistor ("TFT") which is provided on the lower panel 100. A control terminal of the switching element Q is connected to the gate line $G_i$, an input terminal thereof is connected to the data line $D_j$, and an output terminal thereof is connected to both the liquid crystal capacitor Clc and the storage capacitor Cst.

The liquid crystal capacitor Clc has a pixel electrode 191 of the lower panel 100 and a common electrode 270 of the upper panel 200 as two terminals, and the liquid crystal layer 3 interposed between the two electrodes 191 and 270 serves as a dielectric. The pixel electrode 191 is connected to the switching element Q, and the common electrode 270 is formed on the entire surface of the upper panel 200 and is supplied with a common voltage Vcom. Unlike the structure shown in FIG. 3, the common electrode 270 may be provided on the lower panel 100. In this case, at least one of the two electrodes 191 and 270 may be formed in a linear or rod shape.

The storage capacitor Cst, serving as an auxiliary member of the liquid crystal capacitor Clc, comprises a signal line (not shown) provided on the lower panel 100, the pixel electrode 191 and an insulator interposed therebetween. A predetermined voltage, such as the common voltage Vcom, is applied to the signal line. Alternatively, the storage capacitor Cst may be a laminated structure of the pixel electrode 191, the insulator and a previous gate line $G_{i-1}$ formed on the insulator.

Each pixel PX displays a primary color (e.g., one of red, green or blue) (spatial division) or the pixels PX alternately display the primary colors over time (temporal division), which causes the primary colors to be spatially or temporally synthesized, thereby displaying a specific desired color. FIG. 3 shows that each pixel PX has a color filter 230 which displays one of the primary colors in a region of the upper panel 200 corresponding to the pixel electrode 191, as would be the case for spatial division. The color filter 230 may be provided above or below the pixel electrode 191 of the lower panel 100.

At least one polarizer (not shown) which polarizes light is mounted in the liquid crystal panel assembly 300.

Referring to FIGS. 1, 2, 4 and 5, the driver chip 700 includes at least a driving voltage generator 710, an SPI 720, a gray voltage generator 800, a gate driver 400, a data driver 500 and a signal controller 600. Hereinafter, the components 400, 500, 600, 710 and 800, excluding the SPI 720, are referred to as a "driving unit."

The driving voltage generator 710 generates and outputs voltages necessary for driving the display device, for example a gate-on voltage Von which turns on the switching elements Q of the pixels PX, a gate-off voltage Voff which turns off the switching elements Q, a reference voltage GVDD, and a common voltage Vcom which ranges from a low value of VcomL to a high value of VcomH. Hereinafter, these voltages are collectively referred to as "driving voltages."

On the basis of the reference voltage GVDD supplied from the driving voltage generator 710, the gray voltage generator 800 generates either all gray voltages associated with a desired transmittance of the pixels PX or a limited number of gray voltages (hereinafter collectively referred to as "reference gray voltages.") The reference gray voltages may include gray voltages which have positive values and negative values with respect to the common voltage Vcom.

The gate driver 400 is connected to the gate lines $G_1$ to $G_n$ of the liquid crystal panel assembly 300. Further, the gate driver 400 receives the gate-on voltage Von and the gate-off voltage Voff from the driving voltage generator 710, synthesizes the received voltages to generate gate signals, and supplies the gate signals to the gate lines $G_1$ to $G_n$.

The data driver 500 is connected to the data lines $D_1$ to $D_m$ of the liquid crystal panel assembly 300. Further, the data driver 500 selects the gray voltages from the gray voltage generator 800 and applies the gray voltages to the data lines $D_1$ to $D_m$ as data voltages. However, when the gray voltage generator 800 provides a limited number of reference gray voltages rather than all of the gray voltages, the data driver 500 divides the reference gray voltages and selects desired data voltages from the divided voltages.

The signal controller 600 controls the gate driver 400, the data driver 500, and other similar devices.

Figure 5:
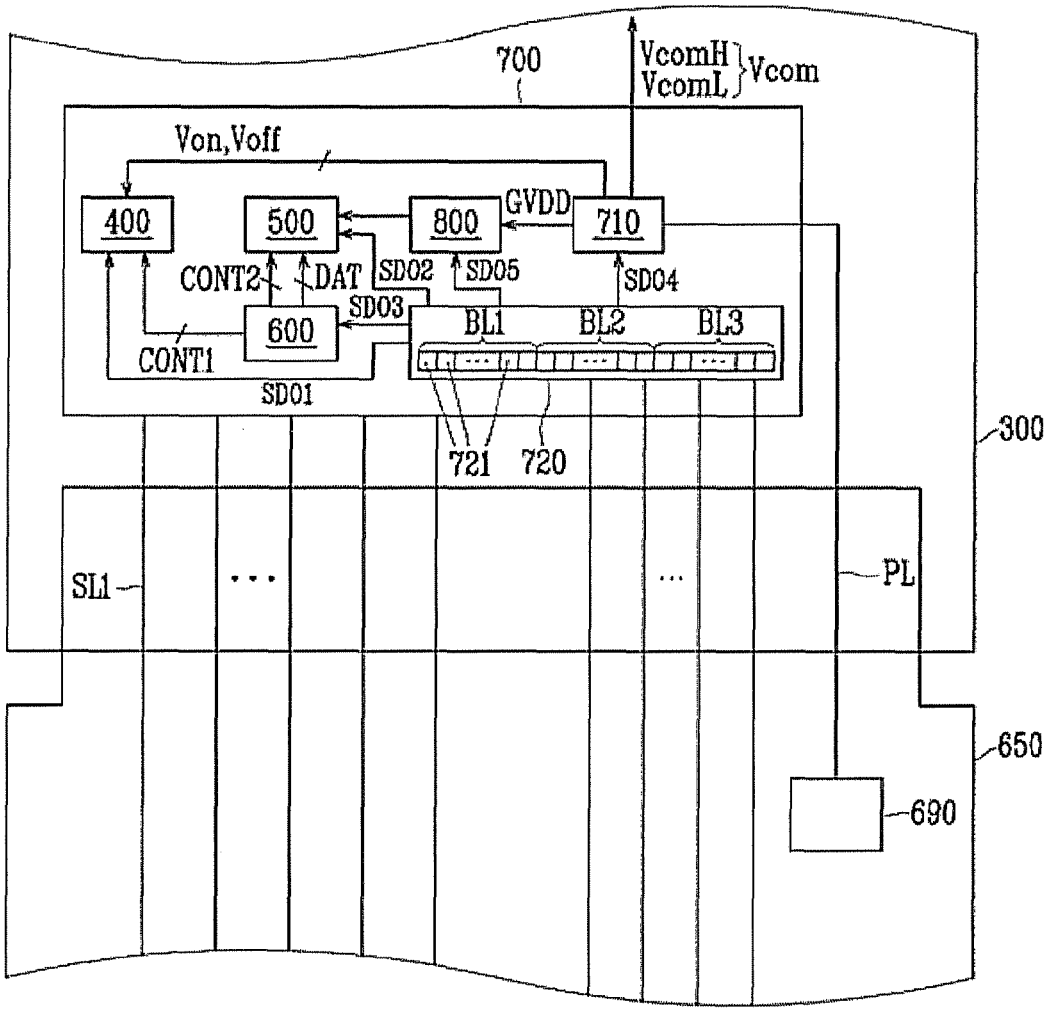
FIG. 5 is a functional partial schematic diagram of the display device according to one exemplary embodiment as shown in FIG. 4.

Referring to FIG. 5, the SPI 720 includes a plurality of registers 721, and the plurality of registers 721 are divided into groups of at least two blocks. In an exemplary embodiment, the plurality of registers 721 are divided into a first block BL1, a second block BL2 and a third block BL3. The SPI 720 controls the gate driver 400, the data driver 500, the signal controller 600, the driving voltage generator 710, the gray voltage generator 800, for example, but is not limited thereto.

At least one of the driving unit 400, 500, 600, 710 and 800, and the SPI 720, or at least one circuit element forming them, may be disposed outside the single driver chip 700. Further, each part of the driving unit 400, 500, 600, 710 and 800 may be directly mounted on the liquid crystal panel assembly 300 in the form of at least one IC chip, may be mounted on a flexible printed circuit film (not shown) and then mounted on the liquid crystal panel assembly 300 in the form of a tape carrier package ("TCP") (not shown), or may be mounted on a separate printed circuit board ("PCB") (not shown). Alternatively, the drivers 400, 500, 600, 710, 720 and 800 may be integrated into the liquid crystal panel assembly 300 together with, for example, the signal lines $G_1$, to $G_n$ and $D_1$ to $D_m$ and the switching elements Q.

Referring to FIGS. 1, 4 and 5, the FPCB 650 is attached adjacent to one side of the liquid crystal panel assembly 300. The FPCB 650 includes a protruding portion 660 which is positioned at a side opposite to the liquid crystal panel assembly 300. External signals are input at the protruding portion 660. The protruding portion 660 and the driver chip 700 are connected to each other through a signal line SL1.

The FPCB 650 includes a passive element portion 690. The passive element portion 690 is connected to the driving voltage generator 710 of the driver chip 700 through a voltage line PL. The passive element portion 690 includes a plurality of passive elements (capacitors, inductors and resistors, for example) necessary for the driving voltage generator 710 to generate the driving voltages. In exemplary embodiments, the voltage line PL and the signal line SL1 do not cross each other. To facilitate this, the driving voltage generator 710 may be located at an opposite end of the driver chip 700 from the signal line SL1.

Referring to FIG. 1, the molded frame 363 which supports the entire display device is located between the top chassis 361 and the bottom chassis 362.

The lighting unit 900 includes a plurality of lamps LP, a circuit element (not shown) which controls the lamps LP, a PCB 670, a light guide plate 902, a reflective sheet 903 and a plurality of optical sheets 901.

The lamps LP are fixed to the PCB 670 which is located adjacent to an edge of a short side of the molded frame 363 to supply light to the liquid crystal panel assembly 300.

The light guide plate 902 guides the light from the lamps LP to the liquid crystal panel assembly 300, and makes the intensity of the supplied light uniform.

The reflective sheet 903 is provided below the light guide plate 902, and reflects the light from the lamps LP onto the liquid crystal panel assembly 300.

The optical sheets 901 are provided above the light guide plate 902 to maintain a desired luminance characteristic of the light from the lamps LP.

The top chassis 361 and the bottom chassis 362 are coupled to each other with the molded frame 363 interposed therebetween, and accommodate the liquid crystal module therein.

Hereinafter, the operation of a display device according to an exemplary embodiment of the present invention will be described in further detail with reference to the accompanying drawings.

Referring to FIG. 2, the signal controller 600 receives external driving signals which control the display device, for example a vertical synchronization signal Vsync, a horizontal synchronizing signal Hsync, a main clock signal MCLK, a data enable signal DE, and other similar signals. Further, the signal controller 600 receives image signals R, G and B which contain desired luminance information for each pixel PX. The luminance information includes a predetermined number of grays, for example 1024 ($=2^{10}$), 256 ($=2^{8}$) or 64 ($=2^{6}$).

The signal controller 600 processes the input image signals R, G and B according to the operating conditions of the liquid crystal panel assembly 300 and on the basis of the input image signals R, G and B and the input control signals, and generates a gate control signal CONT1, a data control signal CONT2, a digital image signal DAT and other similar signals. Further, the signal controller 600 transmits the gate control signal CONT1 to the gate driver 400, and the data control signal CONT2 and the processed digital image signal DAT to the data driver 500.

The gate control signal CONT1 includes a scanning start signal STV (not shown) which instructs scanning to start, and at least one clock signal which controls an output cycle of the gate-on voltage Von. The gate control signal CONT1 may further include an output enable signal OE (not shown) which defines a duration of the gate-on voltage Von.

The data control signal CONT2 includes a horizontal synchronization start signal STH (not shown) which instructs the data driver 500 to start transmission of the digital image signal DAT which corresponds to an appropriate row of pixels PX, a load signal LOAD (not shown) which instructs the data driver 500 to apply an analog data voltage to the data lines $D_1$ to $D_m$, and a data clock signal HCLK (not shown). The data control signal CONT2 may further include an inversion signal RVS (not shown) which inverts the polarity of the data voltage for the common voltage Vcom On the basis of the data control signal CONT2 which is supplied by the signal controller 600, the data driver 500 receives digital image signals DAT for one row of pixels PX, selects gray voltages corresponding to the respective digital image signals DAT, converts the digital image signals DAT into analog data voltages, and applies the analog data voltages to the corresponding data lines $D_1$ to $D_m$.

On the basis of the gate control signal CONT1 which is supplied by the signal controller 600, the gate driver 400 applies the gate-on voltage Von to the gate lines $G_1$ to $G_n$, which turns on the switching elements Q connected to the gate lines $G_1$ to $G_n$. As a result, the data voltage which is supplied to the data lines $D_1$ to $D_m$ is applied to the corresponding pixels PX through the turned on switching elements Q.

The SPI 720 receives an external driving signal, which includes an interface enable signal CS, a serial clock signal SCLK, a serial data input signal SDI. Further, the SPI 720 generates a plurality of serial data output signals SDO based upon the serial data input signal SDI, and transmits the plurality of serial data output signals SDO to each component of the driving unit 400, 500, 600, 710 and 800, which controls each part of the driving unit 400, 500, 600, 710 and 800.

The serial data output signal SDO includes at least a first serial data output signal SDO1 which is supplied to the gate driver 400, a second serial data output signal SDO2 which is supplied to the data driver 500, a third serial data output signal SDO3 which is supplied to the signal controller 600, a fourth serial data output signal SDO4 which is supplied to the driving voltage generator 710, and a fifth serial data output signal SDO5 which is supplied to the gray voltage generator 800.

The difference between the data voltage applied to each pixel PX and the common voltage Vcom is represented as a pixel voltage charged in the liquid crystal capacitor Clc. The level of the pixel voltage determines the alignment of liquid crystal molecules in the liquid crystal layer 3, and the alignment of the liquid crystal molecules determines polarization characteristics of the light from the lamps LP passing through the liquid crystal layer 3. The variation in polarization characteristics causes a variation in transmittance of the light by the polarizer (not shown) mounted on the liquid crystal panel assembly 300. In this way, the luminance of each pixel PX corresponds to the respective gray-scale level of the image signal DAT.

These processes are repeated for each horizontal period 1H (not shown), which is equal to one period of the horizontal synchronizing signal Hsync and the data enable signal DE (not shown). In this way, the gate-on voltage Von is sequentially applied to all of the gate lines $G_1$ to $G_n$, and the data voltage is applied to all of the pixels PX, thereby displaying one frame of images.

When one frame ends, the next frame begins and the state of the inversion signal RVS (not shown) which is applied to the data driver 500 is controlled such that the polarity of the data voltage applied to each pixel PX is opposite to the polarity of the data voltage applied to each pixel PX in the previous frame ("frame inversion.") Further, the polarity of the data voltage applied to one data line may be periodically inverted in the same frame according to the characteristic of the inversion signal RVS (not shown) (for example, row inversion and dot inversion), and the polarities of the data voltages applied to a row of pixels PX may be different from each other (for example, column inversion and dot inversion).

Hereinafter, the operation of the SPI 720 of a display device according to an exemplary embodiment of the present invention will be described in further detail with reference to the accompanying drawings.

Figure 6:
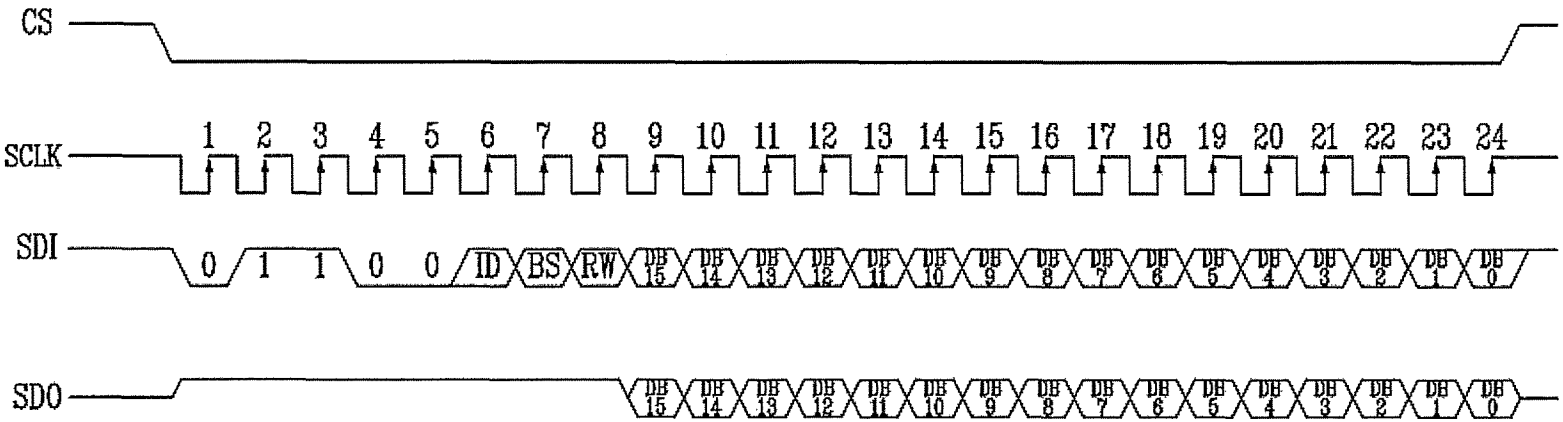
FIG. 6 is a timing chart illustrating input and output signal waveforms of an SPI of the display device according to one exemplary embodiment of the present invention.

Referring to FIGS. 2 and 6, the SPI 720 receives the interface enable signal CS, the serial clock signal SCLK and the serial data input signal SDI, and outputs the plurality of serial data output signals SDO.

The serial data input signal SDI includes at least 24 bits. The first to fifth bits indicate a unique number of the driver chip 700. For example, in FIG. 6 the unique number is represented as "01100." The sixth bit ID and the eighth bit RW are unused bits which do not affect the operation. The seventh bit is a block selecting bit BS. The remaining sixteen bits from the ninth bit to the twenty-fourth bit are data bits DB0 to DB15, and are recognized as either register address bits RI (not shown) or command bits CM (not shown).

The SPI 720 transmits the serial data output signal SDO and the command bit CM (not shown) to each part of the driving unit 400, 500, 600, 710 and 800, such that the SPI 720 controls the driving unit 400, 500, 600, 710 and 800. The serial data output signal SDO includes at least the first to fifth serial data input signals SDO1 to SDO5 as shown in FIGS. 2 and 5.

The SPI 720 recognizes the serial clock signal SCLK when a voltage level of the interface enable signal CS changes from a high level to a low level. That is, the period when the interface enable signal CS is at a low level is the effective period of the serial clock signal SCLK.

Referring to FIGS. 5 and 6, according to one exemplary embodiment of the present invention the SPI 720 includes the plurality of registers 721, and the plurality of registers 721 are divided into the three blocks BL1, BL2 and BL3.

When the seventh, or block selecting bit BS of the serial data input signal SDI is 1, the ninth to twenty-fourth bits of the serial data input signal SDI are recognized as block address bits BI (not shown). For example, when the values of the ninth to twenty-fourth bits of the serial data input signal SDI are 0000000000000001 the first block BL1 is selected, when the values are 0000000000000010 the second block BL2 is selected, and when the values are 0000000000000011 the third block BL3 is selected, etc.

When the block selecting bit BS of the serial data input signal SDI is 0, the ninth to twenty-fourth bits are recognized as command bits CM (not shown) which correspond to the various serial data output signals SDO which control the driving unit 400, 500, 600, 710 and 800. In particular, the command bits which are inputted to the first block BL1 can control the signal controller 600, for example to change the backporch of the vertical synchronizing signal Vsync or the horizontal synchronizing signal Hsync. The command bits which are inputted to the second block BL2 can control the driving voltage generator 710, for example to generate the driving voltages. The command bits which are inputted to the third block BL3 can control the gray voltage generator 800, for example to generate the gray voltages.

According to one exemplary embodiment of the present invention, the plurality of registers 721 may be further divided into groups of a larger number of blocks, e.g., more than three, and the serial data output signal SDO which corresponds to the command bit applied to each block can control each part of the driving unit 400, 500, 600, 710 and 800, for example, but is not limited thereto.

Therefore, when the plurality of registers 721 are divided into the plurality of blocks and each of the blocks is selected according to the block selecting bit BS, the command bits CM are simultaneously input to the respective registers 721 of the corresponding selected block. As a result, the operating speed of the SPI 710 is increased because there is no need to individually select the registers 721.

While the present invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A display device, comprising:

a display panel assembly;

a driving unit which drives the display panel assembly; and a serial peripheral interface which receives an external driving signal, controls the driving unit, and comprises a plurality of registers, wherein the plurality of registers is divided into at least two blocks, wherein the driving signal comprises a serial data input signal, which comprises a block selecting bit as a single bit and data bits, wherein the block selecting bit is configured to select one block of the at least two blocks allowing the data bits to be applied to the registers associated with the selected one block, and wherein when the block selecting bit is a first predetermined binary value, the data bits are recognized as block address bits which indicate an address of the one block, and when the block selecting bit is a second predetermined binary value different from the first predetermined binary value, the data bits are recognized as command bits which control the driving unit, wherein the display panel assembly comprises a pixel comprising a switching element; and the driving unit comprises:

a driving voltage generator which generates driving voltages which drive the display panel assembly, a gate driver which generates a gate signal based on one of the driving voltages and applies the gate signal to the switching element, a gray voltage generator which generates a gray voltage based on one of the driving voltages, a data driver which generates a data voltage based on the gray voltage and applies the generated data voltage to the switching element, and a signal controller which controls at least one of the driving voltage generator, the gate driver, the gray voltage generator, and the data driver, and wherein the at least two blocks comprise a first block and a second block and a command bit input to the first block comprises data which controls the signal controller and a command bit input to the second block comprises data which controls the generation of the driving voltages.

2. The display device of claim 1, wherein when the block selecting bit is 0, the data bits are recognized as block address bits which indicate an address of the one block, and when the block selecting bit is 1, the data bits are recognized as command bits which control the driving unit.

3. The display device of claim 1, wherein:

the at least two blocks further comprise a third block; and a command bit input to the third block comprises data which controls the generation of the gray voltage.

4. The display device of claim 1, wherein the driving voltages comprise a gate-on voltage and a gate-off voltage which are applied to the gate driver, a reference voltage which is applied to the gray voltage generator, and a common voltage which is applied to the pixel.

5. The display device of claim 1, wherein the driving unit and the serial peripheral interface are implemented in the form of a single integrated circuit chip.

6. The display device of claim 5, wherein the integrated circuit chip is directly mounted on the display panel assembly.

7. The display device of claim 1, wherein:

the driving signal further comprises an interface enable signal and a serial clock signal; and the serial peripheral interface recognizes the serial clock signal when a voltage level of the interface enable signal changes from a high level to a low level.

8. The display device of claim 1, wherein the number of data bits is 16.

9. The display device of claim 1, further comprising a circuit board attached to the display panel assembly and electrically connected to the driving unit and the serial peripheral interface.

10. The display device of claim 9, wherein the circuit board is flexible.

11. A method of driving a display device which comprises a display panel assembly, a driving unit which drives the display panel assembly, and a serial peripheral interface comprising a plurality of registers divided into at least two blocks, the method comprising:

inputting a block selecting bit as a single bit to the serial peripheral interface; and inputting data bits to a selected block of the at least two blocks according to the block selecting bit, wherein when the block selecting bit is a first predetermined binary value, the data bits are recognized as block address bits which indicate an address of the one block, and when the block selecting bit is a second predetermined binary value different from the first predetermined binary value, the data bits are recognized as command bits which control the driving unit, wherein the display panel assembly comprises a pixel comprising a switching element; and the driving unit comprises:

a driving voltage generator which generates driving voltages which drive the display panel assembly, a gate driver which generates a gate signal based on one of the driving voltages and applies the gate signal to the switching element, a gray voltage generator which generates a gray voltage based on one of the driving voltages, a data driver which generates a data voltage based on the gray voltage and applies the generated data voltage to the switching element, and a signal controller which controls at least one of the driving voltage generator, the gate driver, the gray voltage generator, and the data driver, and wherein the at least two blocks comprise a first block and a second block and a command bit input to the first block comprises data which controls the signal controller and a command bit input to the second block comprises data which controls the generation of the driving voltages.

12. The method of claim 11, wherein when the block selecting bit is 1, the data bits designate any one of the at least two blocks.

13. The method of claim 11, wherein when the block selecting bit is 0, the data bits which are applied to the selected block are recognized as command bits which control the driving unit.

14. The method of claim 11, wherein:

the at least two blocks further comprise a third block; and a command bit input to the third block comprises data which controls the generation of the gray voltage.

* * * * *